United States Patent [19]

Gervais et al.

[11] Patent Number: 4,549,598

[45] Date of Patent: Oct. 29, 1985

[54] PROCESS FOR MINIMIZING FOAM FORMATION DURING FREE FALLING OF MOLTEN METAL INTO MOULDS, LAUNDERS OR OTHER CONTAINERS

[75] Inventors: Edouard Gervais, Montréal; Henri Levert, Lachine, both of Canada

[73] Assignee: Noranda Inc., Pointe-Claire, Canada

[21] Appl. No.: 443,683

[22] Filed: Nov. 22, 1982

Related U.S. Application Data

[63] Continuation-in-part of Ser. No. 331,755, Dec. 17, 1981, abandoned, which is a continuation of Ser. No. 178,584, Aug. 15, 1980, abandoned.

[51] Int. Cl.[4] ..... B22D 23/00

[52] U.S. Cl. ..... 164/66.1; 164/259

[58] Field of Search ..... 164/66.1–68.1, 164/475, 259, 415; 75/96

[56] References Cited

U.S. PATENT DOCUMENTS

| | | | |
|---|---|---|---|
| 280,349 | 7/1983 | Clamer et al. | 75/96 X |
| 1,403,349 | 1/1922 | Shimer | 75/96 |
| 3,689,048 | 9/1972 | Foulard et al. | 164/66.1 X |
| 3,880,221 | 4/1978 | Balevski et al. | 164/475 X |

FOREIGN PATENT DOCUMENTS 0088701 9/1983 European Pat. Off. .

OTHER PUBLICATIONS

Weldon, "Melting and Casting of Market Shapes", Zinc—The Metal, Its Alloys and Compounds, C. H. Mathewson, Monograph Series #142.

Meisel, "New Generation Zinc Plants, Design Features and Effect on Costs", Journal of Metals, Aug. 25, 1974.

C. H. Mathewson, "Zinc The Science and Technology of the Metal, Its Alloys and Compounds", pp. 325–326.

*Primary Examiner*—Kuang Y. Lin

*Attorney, Agent, or Firm*—Fleit, Jacobson, Cohn & Price

[57] ABSTRACT

A process for minimizing foam formation on the top surface of molten metal during free falling of molten metal, such as molten zinc, into moulds, launders or other containers is disclosed. The process comprises the steps of forming a body of substantially dross-free molten metal, introducing a non-oxidizing gas into the container to form an essentially non-oxidizing atmosphere with respect to the molten metal, free falling the molten metal from the body of molten metal into the container, and maintaining the molten metal during the free falling thereof under an essentially non-oxidizing atmosphere, so as to prevent entrainment of sufficient oxygen into the molten metal by the falling stream to form excessive quantities of bubbles having a tenacious oxidized film and which do not collapse when they float to the surface of the molten metal but rather produce undesirable foam on the surface of molten metal.

7 Claims, 1 Drawing Figure

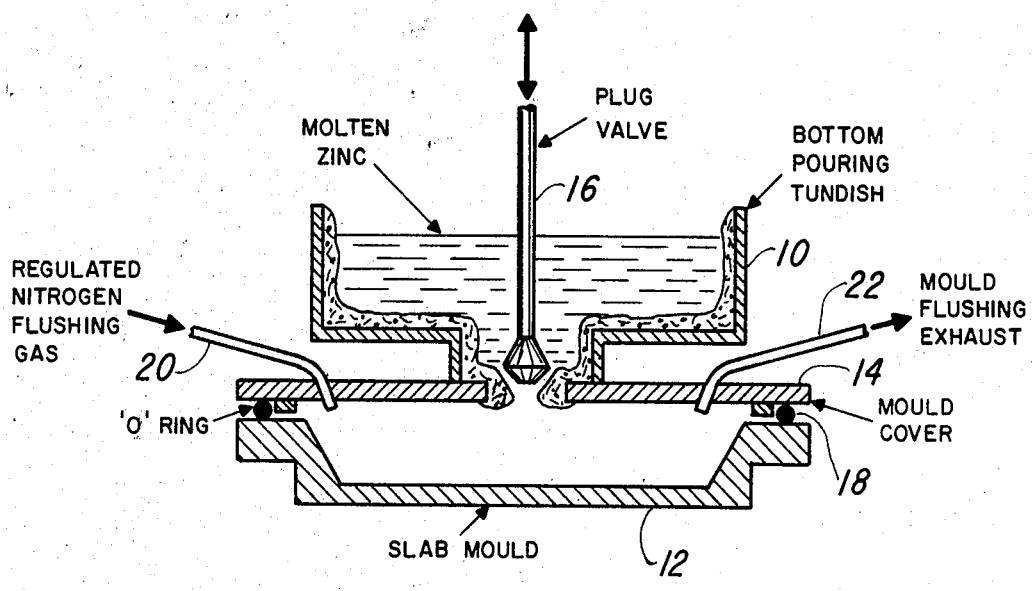
PLUG
VALVE
MOLTEN
ZINC
BOTTOM
POURING
TUNDISH
16
10
REGULATED
NITROGEN
FLUSHING
GAS
22
MOULD
FLUSHING
EXHAUST
20
14
'O' RING
MOULD
COVER
18
SLAB MOULD
12

PROCESS FOR MINIMIZING FOAM FORMATION DURING FREE FALLING OF MOLTEN METAL INTO MOULDS, LAUNDERS OR OTHER CONTAINERS

This application is a continuation-in-part of application Ser. No. 331,755, filed Dec. 17, 1981, which is a continuation of application Ser. No. 178,584, filed Aug. 15, 1980, both now abandoned.

This invention relates to a process for minimizing foam formation on the top surface of molten metal during pouring of the metal into moulds, launders or similar containers, or during free falling of molten metal from a furnace to a launder, or cascading of the metal from launder to launder.

When casting molten metal, such as zinc, a considerable amount of metallic foam is formed on the top surface of the molten metal. This foam is normally skimmed off the surface of the molten metal manually. The task is arduous, requires workers to be in close proximity to molten metal and produces significant amounts of skimmings from which the metal must then be reclaimed. In addition to such foam, the molten metal usually contains on its surface a substantial amount of floating impurities, called "dross". In a conventional operation, such dross is usually not removed separately from the foam, but rather forms a part of the total skimmings which are manually removed from the surface of the molten metal after pouring into moulds, launders or similar containers.

Experiments carried out by the applicant during pouring of molten zinc into moulds have revealed that the formation of foam was due to the entrainment of air by the falling stream of molten metal. Hence air is transported below the molten metal surface to form air bubbles within the molten metal. Due to oxidation, a thin but tenacious zinc oxide film is formed on the inside surface of the bubbles. These bubbles rise to the surface and, as they emerge at the surface, it is observed that the outer surface of the bubbles is also oxidized and, in the case of large bubbles (approximately ½ inch diameter), the emerging upper skin of the bubble may freeze immediately although the metal pool beneath it remains liquid for several minutes longer.

Having realized that the foam formed on top of the molten metal is due to the formation of bubbles consisting of a tenacious zinc oxide film, applicant investigated several methods by which the bubbles could be either released or prevented from forming. As a result of such investigation, applicant has discovered, in accordance with the invention, that foam formation may be minimized during free falling of molten metal into moulds, launders or other containers by forming a body of substantially dross-free molten metal, introducing a non-oxidizing gas into the container to form an essentially non-oxidizing atmosphere with respect to the molten metal, free falling the molten metal from said body of molten metal into the container and maintaining the molten metal during the free falling thereof under an essentially non-oxidizing atmosphere, so as to prevent entrainment of sufficient oxygen into the molten metal by the falling stream to form excessive quantities of bubbles having a tenacious oxidized film and which do not collapse when they float to the surface of the molten metal but rather produce undesirable foam on said surface.

The non-oxidizing atmosphere is preferably formed by using an inert gas, such as nitrogen, and it can usually contain a small quantity of oxygen, e.g. up to approximately 2%, without producing excessive quantities of bubbles.

The body of substantially dross-free molten metal should be formed prior to the pouring of the metal, because dross will not be eliminated by manual skimming at a later stage. This is done either by producing molten metal without dross or by removing the dross before pouring the metal into moulds or the like.

The above disclosed method may be carried out by placing a cover over the top of the molten metal container, such cover having an aperture therein for passage of the molten metal and means for introducing a non-oxidizing gas under the cover. The invention could also be carried out on a continuous slab casting machine by providing a hood over the area of the casting machine at the filling station and introducing a non-oxidizing gas under the hood. The hood would have an opening for introducing the molten metal through one of the walls of the hood.

The invention will now be disclosed with reference to an apparatus used to carry out laboratory experiments which is illustrated in the accompanying drawing.

The sole FIGURE is a vertical sectional view of a zinc casting apparatus according to the present invention.

The apparatus comprises a bottom-pouring tundish 10 which is used to feed molten zinc into a slab mould 12 through a cover 14 closing the top of the mould. The bottom of the tundish is provided with an opening registering with a corresponding opening in the cover 14 and is sealed to the cover by any suitable means such as by welding. The opening in the bottom of the tundish is closed by a plug valve 16 which may be opened when it is desired to pour molten metal into the mould. The cover is sealed to the mould by 'O' ring 18. A metered nitrogen inlet 20 and exhaust vent 22 are provided through the cover to maintain a suitable non-oxidizing atmosphere within and above the mould.

A simple experimental procedure was carried out involving filling the tundish with dross-free molten zinc, purging the covered mould and the space above it with nitrogen and then opening the valve to fill the mould. There was a sufficient quantity of molten zinc in the tundish to prevent entrainment of air from the surface of the molten zinc during pouring thereof into the mould. In addition, no oxidizing gas is entrained with the falling stream of molten zinc because the mould as well as the space above it are under a nitrogen atmosphere. The mould was uncovered soon after filling, before solidification to allow freezing of metal in air. A series of casting trials were carried out while varying the metal casting temperature and the concentration of oxygen in the nitrogen atmosphere.

The effects of varying metal casting temperature were observed in the normal zinc casting temperature range of 440°–530° C. Purging was carried out at gas flow rates of 20 l/min. for one minute with nitrogen atmospheres ranging from commercial purity to concentrations of 2% oxygen. Foam-free surfaces on slab ingots were obtained with concentrations of oxygen in nitrogen varying from 0 to about 2%. It was also observed that the effects of temperature and oxygen are interactive as far as the production of acceptable slab surfaces is concerned. The conditions which produce acceptable surfaces on slab ingots are summarized below by way of example:

(a) Commercially-pure nitrogen atmosphere at temperatures less than 450° C. These conditions produce a brilliant, crystalline surface which is visible through a fully transparent oxide film. At temperatures higher than 450° C. the phenomenon commonly referred to as "colouration" in which colours ranging from straw to dark purple were observed.

(b) Oxygen concentrations of approximately 2% at temperatures in the range of 450°–475° C. These conditions result in a smooth silvery oxide film at the ingot surface.

The invention may also be carried out on a continuous slab casting machine, such as the Sheppard casting machine which has a number of moulds mounted on an endless conveyor chain. On such machines, the non-oxidizing atmosphere may be provided within a hood surrounding the area of the casting machine at the filling station. The hood would normally extend over a number of moulds so as to permit the molten metal in the moulds to cool below a predetermined temperature before emerging from the hood in order to control the formation of zinc oxide on the surface of the metal. Molten metal would be fed from a furnace to a pouring ladle located inside the hood through a suitable trap or filter to remove dross from the surface of the molten metal. The molten metal would then be poured from the pouring ladle into the moulds as they move past the filling station under the non-oxidizing atmosphere formed inside the hood and within the moulds. Thus no oxidizing gas would be entrained with the molten metal in the pouring ladle even under turbulent conditions because the surface of the pouring ladle is in contact with a non-oxidizing atmosphere. Furthermore, the falling stream of molten metal is also in contact with a non-oxidizing atmosphere to prevent entrainment of oxidizing gas into the moulds.

A metered nitrogen inlet and exhaust vent would be provided through the hood to form the non-oxidizing atmosphere in the hood. The nitrogen atmosphere within the hood must be maintained at a slight positive pressure such that the ambient oxidizing atmosphere outside the hood cannot enter the hood through the mould entrance and exit ports. Curtains or other sealing means are preferably provided where the moulds enter and exit the hood to prevent excessive loss of nitrogen gas.

Although the method in accordance with the present invention has been disclosed in association with a specific apparatus, it is to be understood that it could be carried out by other means including various types of continuous casting machines and that the invention is not limited to carrying out the novel method with the specific apparatus disclosed.

We claim:

1. A process for minimizing foam formation on the surface of molten metal zinc which forms a foam during free falling of the molten metal zinc into moulds, launders or other containers, so as to eliminate the need for skimming, which comprises:

(1) forming a body of molten metal zinc having a substantially dross-free surface;

(2) introducing a non-oxidizing gas into said container to form an essentially non-oxidizing atmosphere with respect to said molten metal zinc;

(3) free falling said molten metal zinc having a substantially dross-free surface from said body of molten metal zinc into said container so as to eliminate the need for skimming dross from the surface of said molten metal zinc after free falling of said molten metal zinc into said container, and (4) maintaining said molten metal zinc during said free falling thereof under an essentially non-oxidizing atmosphere so as to prevent entrainment of sufficient oxygen into said molten metal zinc by said falling stream to form excessive quantities of bubbles having a tenacious oxidized film and which do not collapse when they float to the surface of said molten metal zinc but rather produce undesirable foam on said surface, so as to eliminate the need for skimming foam from said surface.

2. A process as defined in claim 1 wherein said non-oxidizing atmosphere is an inert gas atmosphere.

3. A process as defined in claim 2, wherein the inert gas in nitrogen.

4. A process as defined in claim 1, wherein the non-oxidizing atmosphere contains a small quantity of oxygen.

5. A process as defined in claim 1, wherein a metal body substantially free of surface foam is produced and allowed to solidify in air to a solid shape.

6. A process as defined in claim 1, wherein the gas atmosphere contains approximately 2% oxygen and the temperature of the molten zinc is maintained between 450° to 475° C.

7. A process as defined in claim 1, wherein the molten metal zinc is maintained at a temperature less than 450° C. and the non-oxidizing atmosphere is essentially free of oxygen.

* * * * *